US007793732B2

(12) United States Patent
Xu et al.

(10) Patent No.: US 7,793,732 B2
(45) Date of Patent: Sep. 14, 2010

(54) BACKPRESSURE VALVE FOR WIRELESS COMMUNICATION

(75) Inventors: Zheng Rong Xu, Sugar Land, TX (US); Gokturk Tunc, Stafford, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 135 days.

(21) Appl. No.: 12/135,682

(22) Filed: Jun. 9, 2008

(65) Prior Publication Data

US 2009/0301713 A1 Dec. 10, 2009

(51) Int. Cl.
*E21B 34/00* (2006.01)

(52) U.S. Cl. ..... 166/386; 166/325

(58) Field of Classification Search ..... 166/386, 166/325

See application file for complete search history.

(56) References Cited

U.S. PATENT DOCUMENTS 2,919,709 A 1/1960 Schwegman
3,040,710 A 6/1962 Wilder
3,051,246 A 8/1962 Clark, Jr. et al.
3,954,138 A 5/1976 Miffre
4,645,006 A 2/1987 Tinsley
4,646,844 A 3/1987 Roche et al.
5,320,181 A 6/1994 Lantier, Sr. et al.
2009/0250223 A1 * 10/2009 Erkol et al. ..... 166/373

* cited by examiner

*Primary Examiner*—William P Neuder
(74) *Attorney, Agent, or Firm*—Rodney Werfford; Michael L. Flynn; Robin Nava

(57) ABSTRACT

A backpressure valve. The backpressure valve may be configured to maintain a substantially controlled pressure in coiled tubing uphole thereof while simultaneously being compatible with a pressure pulse tool downhole thereof. The backpressure valve includes pressure generating capacity below its internal valve assembly so as to avoid the tendency of the assembly to throttle open and closed. Furthermore, the pressure generation is achieved in a manner avoiding cavitation. As a result, once the backpressure valve is opened, the pressure pulse tool is able to reliably communicate with surface equipment at the oilfield.

32 Claims, 5 Drawing Sheets

BACKPRESSURE VALVE FOR WIRELESS COMMUNICATION

FIELD OF THE INVENTION

Embodiments described relate to coiled tubing for use in hydrocarbon wells. In particular, embodiments of coiled tubing are described utilizing a backpressure valve at a downhole end thereof to maintain a pressure differential between the coiled tubing and an environment in a well. Additionally, such coiled tubing may also be compatibly employed with pressure signal generating tools positioned downhole of the valve.

BACKGROUND OF THE RELATED ART

Exploring, drilling and completing hydrocarbon and other wells are generally complicated, time consuming and ultimately very expensive endeavors. As a result, over the years, well architecture has become more sophisticated where appropriate in order to help enhance access to underground hydrocarbon reserves. For example, as opposed to wells of limited depth, it is not uncommon to find hydrocarbon wells exceeding 30,000 feet in depth. Furthermore, as opposed to remaining entirely vertical, today's hydrocarbon wells often include deviated or horizontal sections aimed at targeting particular underground reserves. Indeed, it is not uncommon for a well to include a main vertical borehole with a variety of lateral legs stemming therefrom into a given formation.

While more sophisticated well architecture may increase the likelihood of accessing underground hydrocarbons, the nature of such wells presents particular challenges in terms of well access and management. For example, during the life of a well, a variety of well access applications may be performed within the well with a host of different tools or measurement devices. However, providing downhole access to wells of such challenging architecture may require more than simply dropping a wireline into the well with the applicable tool located at the end thereof. Thus, coiled tubing is frequently employed to provide access to wells of more sophisticated architecture.

Coiled tubing operations are particularly adept at providing access to highly deviated or tortuous wells where gravity alone fails to provide access to all regions of the wells. During a coiled tubing operation, a spool of pipe (i.e., a coiled tubing) with a downhole tool at the end thereof is slowly straightened and forcibly pushed into the well. This may be achieved by running coiled tubing from the spool and through a gooseneck guide arm and injector which are positioned over the well at the oilfield. In this manner, forces necessary to drive the coiled tubing through the deviated well may be employed, thereby delivering the tool to a desired downhole location.

As the coiled tubing is driven into the well as described, a degree of fluid pressure may be provided within the coiled tubing. At a minimum, this pressure may be enough to ensure that the coiled tubing maintains integrity and does not collapse. However, in many cases, the downhole application and tool may require pressurization that substantially exceeds the amount of pressure required to merely ensure coiled tubing integrity. As a result, measures may be taken to prevent fluid leakage from the coiled tubing and into the well. As described below, the importance of these measures may increase as the disparity between the pressure in the coiled tubing and that of the surrounding well environment also increases.

For example, it would not be uncommon for a low pressure well of about 2,000 PSI or so to accommodate coiled tubing at a vertical depth of over 10,000 feet. Due to the depth, if the coiled tubing is filled with a fluid such as water, hydrostatic pressure upwards of 5,000 PSI would be found at the downhole end of the coiled tubing. That is, even without any added pressurization, the column of water within the coiled tubing will display pressure at the end of the coiled tubing that exceeds the surrounding pressure of the well by over 3,000 PSI. Therefore, in order to prevent uncontrolled leakage of fluid into the well from the coiled tubing, a backpressure valve may be located at the terminal end of the coiled tubing. In this manner, uncontrolled leakage may be avoided, for example, to avoid collapse of the coiled tubing as noted above, and for a host of other purposes.

In many circumstances, downhole tools may be provided downhole of the backpressure valve. For example, a clean-out tool for cleaning debris from a lateral leg as described above may be disposed at the terminal end of the downhole assembly. Theoretically, a locating tool configured for locating a lateral leg stemming from the main borehole as described above may similarly be coupled to the backpressure valve above the clean-out tool. For such an application, an uninterrupted fluid path would be maintained between surface equipment and the locating tool. In this manner, the locating tool could communicate with surface equipment via pulse telemetry. That is, upon locating of a lateral leg, the tool may be configured to effect a temporary but discrete pressure change through the coiled tubing flow that may be detected by the surface equipment.

In an attempt to allow the pulse telemetry to be effectively employed, the backpressure valve above the locating tool may be opened when the tool is positioned downhole near the sought lateral leg. In theory, this would allow any pulse generated by the tool to make its way uphole through the coiled tubing and to the surface equipment. So, for example, where a surface equipment is employed to pump about 1 BPM of fluid through the coiled tubing to achieve a detectable pressure of about 5,000 PSI, the locating tool may be configured with an expandable flow-restrictor to effect a detectable pressure drop to about 4,500 PSI. That is, upon encountering the lateral leg, the flow-restrictor of the locating tool may expand in order to generate the detected pressure drop. With the lateral leg located, the clean-out tool would then be advanced thereinto for clean out of debris.

Unfortunately, the described technique of employing a pulse generating tool, such as the indicated locating tool, downhole of a backpressure valve, remains impractical. This is due to the fact that a conventional backpressure valve is subject to periodic throttling of the valve between open and closed positions with the closed position killing any signal from the locating tool. That is, once uphole pressure cracks open the backpressure valve, an equilibrium between pressure at either side of the valve is naturally sought, allowing the valve and seat to periodically open and close relative to one another in an uncontrolled manner. Thus, as a practical matter, where a pressure differential between the well and coiled tubing is significant enough to require use of a backpressure valve, hydraulic pulse communication from below the valve remains an unavailable option.

SUMMARY

A backpressure valve is provided to substantially maintain controlled pressure in coiled tubing disposed within a well. The valve may have a housing with an uphole portion for coupling to the coiled tubing and a downhole portion for coupling to a downhole tool. A valve is disposed within the housing at an interface of the uphole and downhole portions. The valve may be employed to open and close in order to provide pressure control as directed by an operator. Additionally, a pressure generating mechanism is disposed within the downhole portion to substantially prevent throttling of the valve when open.

DETAILED DESCRIPTION

Embodiments are described with reference to certain coiled tubing operations employing a downhole tool configured to communicate with surface equipment and the operator through the coiled tubing via pressure pulses. An embodiment of a backpressure valve with a pressure generating mechanism incorporated therein is coupled to the downhole tool that is of a configuration to allow pressure pulse communication therethrough. In the embodiments depicted herein, the downhole tool is a locating tool in the form of a multilateral tool for locating a horizontal or lateral leg off of a primary borehole. However, a variety of other locating tools or other tool types employing pressure pulse communication may be employed. Regardless, embodiments of the backpressure valve are configured to help ensure pressure signal communication between the tool and surface equipment at the oilfield may be permitted and maintained without signal interruption by throttling of the backpressure valve.

Figure 1:
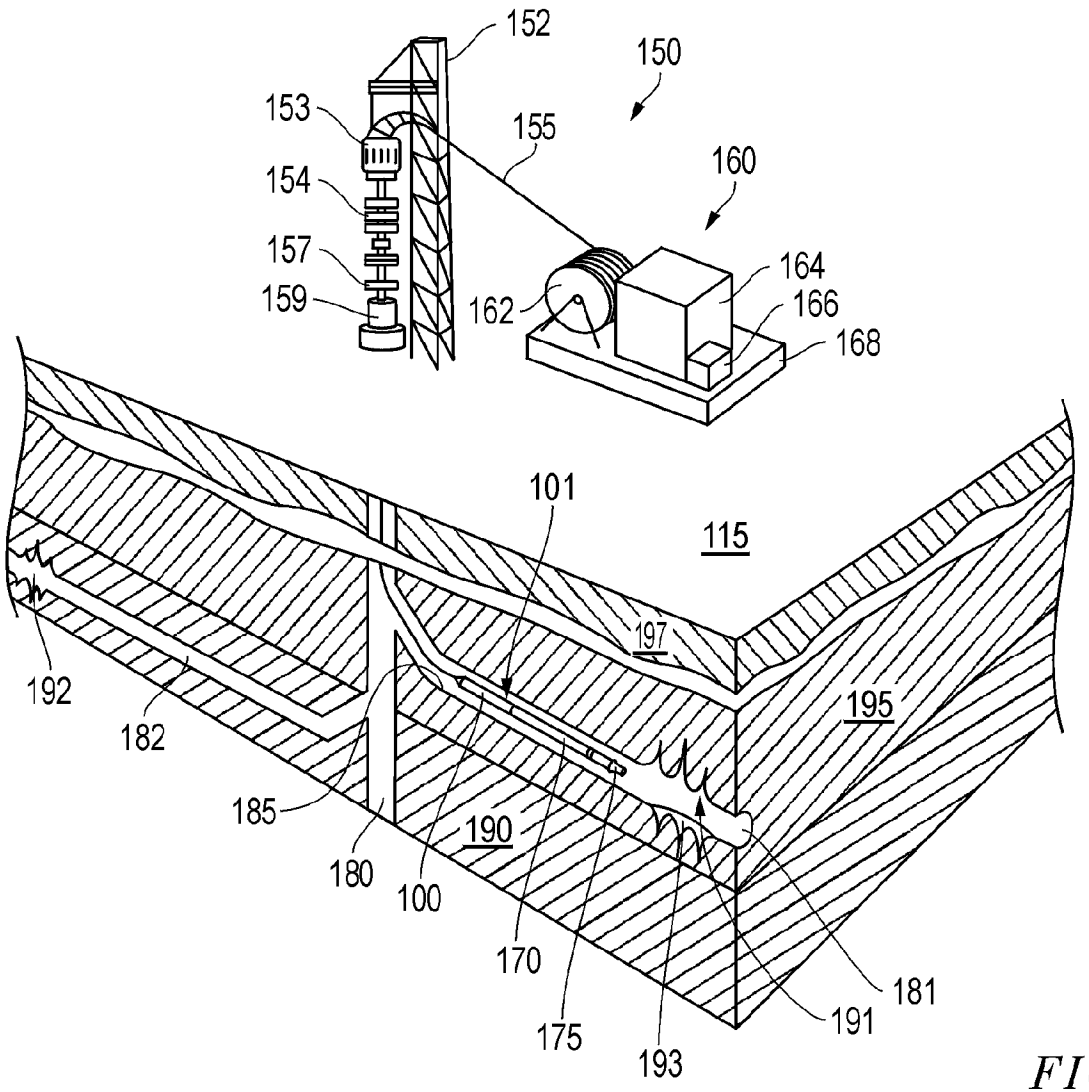
FIG. 1 is an oilfield overview depicting a bottom hole assembly within a well and employing an embodiment of a backpressure valve incorporating a pressure generating mechanism.

Referring now to FIG. 1, an overview of an oilfield 115 is depicted where coiled tubing 155 is employed to deliver a bottom hole assembly 101 to a well. More specifically, the coiled tubing 155 is employed to deliver the assembly 101 to a lateral leg 181 off of a main borehole 180 of the well. For example, in the embodiment depicted, the assembly 101 may include an application tool such as a clean-out nozzle 175 at an end thereof for removal of debris 193 clogging a production region 191 of the lateral leg 181.

As shown, the main borehole 180 traverses a variety of formation layers 197, 195, 190 and the overall architecture of the well is fairly sophisticated. For example, in addition to the lateral leg 181 noted above, another lateral leg 182 may stem from the main borehole 180 and include its own production region 192. As such, the bottom hole assembly 101 may be equipped with a pulse communication tool 170 in the form of a multilateral tool for locating the proper lateral leg 181 into which the assembly 101 is to be positioned. That is, given the sophisticated architecture of the well, positioning of the bottom hole assembly 101 for removal of the depicted debris 193 may involve a bit more than simply dropping the coiled tubing 155 into the main borehole 180 and pushing with surface equipment 150. Rather, a tool 170 and technique for proper positioning of the bottom hole assembly 101 as depicted may be employed as detailed further below.

Continuing with reference to FIG. 1, the bottom hole assembly 101 is delivered to the location depicted in order to perform a clean-out application as noted above. However, beyond merely locating the lateral leg 181, advancing of the assembly 101 through the horizontally oriented leg 181 presents a degree of challenge in and of itself Therefore, the surface equipment 150 depicted at the oilfield 115 includes an injector assembly 153 supported by a tower 152. The injector assembly 153 may be employed to acquire the coiled tubing 155 from a rotating spool 162 and drive it through a blowout preventer stack 154, master control valve 157, well head 159, and/or other surface equipment 150 and into the main borehole 180.

Once the assembly is oriented within the lateral leg 181, the injector assembly 153 is configured to continue driving the coiled tubing 155 with force sufficient to overcome the deviated nature of the leg 181. For example, as depicted in FIG. 1, the coiled tubing 155 is forced around a bend in the leg 181 and to the horizontal position shown. The driving forces supplied by the injector assembly 153 are sufficient to overcome any resistance imparted on the coiled tubing 155 and the assembly 101 by the wall 185 of the leg 181 as the assembly 101 traverses the noted bend.

The above noted surface equipment 150 includes coiled tubing equipment 160 that is provided to the oilfield 115 by way of a conventional skid 168. However, a coiled tubing truck or other mobile delivery mechanisms may be employed for positioning of the equipment 160 at the oilfield 115. Regardless, the coiled tubing equipment 160 includes a fluid pump 164 for pumping fluid into the coiled tubing 155. Similarly, a hydraulic pressure detector 166 is provided to monitor a pressure of the fluid within the coiled tubing 155 during an operation.

In one embodiment, about 10,000 ft. of coiled tubing 155 may be present between the injector assembly 153 and the bottom hole assembly 101 with another 10,000 ft. between the injector assembly 153 and around the spool 162. Furthermore, the fluid pump 164 may be employed to generate a flow rate of about 1 BPM through the entire 20,000 ft. of coiled tubing 155 in order to provide an uninterrupted fluid channel therethrough. Depending on a variety of conditions, this may result in a hydrostatic pressure of say about 5,000 PSI detectable at the pressure detector 166. However, as detailed further below, a pressure pulse which is detectable by the pressure detector 166 may be transmitted from the borehole assembly 101 to the detector 166 upon changing downhole pressure conditions. Thus, changing conditions may be employed to communicate with an operator at the surface.

Figure 2:
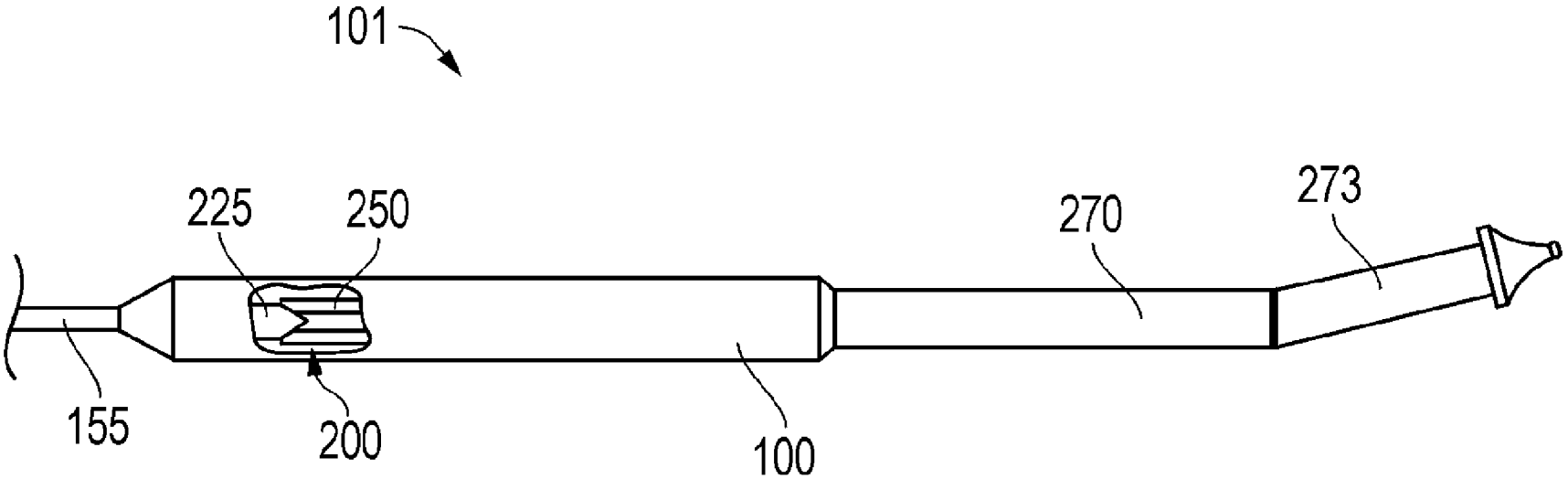
FIG. 2 is a partially sectional view of the bottom hole assembly of FIG. 1, revealing a valve assembly within the backpressure valve.

Continuing now with added reference to FIG. 2, the backpressure valve 100 is provided to the assembly 101 in order to ensure that sufficient fluid is maintained within the coiled tubing 155. For example, the well may be of low bottom hole pressure, say about 2,000 PSI, whereas the pressure at the end of the 10,000 ft. of substantially vertical coiled tubing 155 is likely to exceed about 5,000 PSI. Therefore, the backpressure valve 100 may be employed to help avoid fluid leakage into the well. Thus, an uninterrupted fluid channel through the coiled tubing 155 may be maintained as noted.

More specifically, as shown in FIG. 2, a valve assembly 200 of the backpressure valve 100 may be closed with a movable seat 250 positioned against a stationary valve 225 in order to limit fluid flow out of the coiled tubing 155 and into the well. However, as indicated above, hydraulic pressure pulse communication between the pulse communication tool 170 and the pressure detector 166 may be desirable at times. Thus, as detailed further below, the valve assembly 200 may be opened by application of sufficient hydraulic pressure. This may be initiated by an operator through the fluid pump 164 as the assembly 101 reaches a particular estimated downhole location. Furthermore, once cracked open, the valve assembly 200 may be configured to remain open without any significant throttling thereof As such, pressure communication may reliably proceed between the tool 170 downhole of the backpressure valve 100 and the pressure detector 166 at the surface of the oilfield 115 without interference by the valve assembly 200. In one embodiment, the pressure pulse is generated as an angle between stationary 270 and arm 273 portions of the tool 170 is reduced by a predetermined amount. This manner of pressure pulse communication is described in greater detail below.

Figure 3:
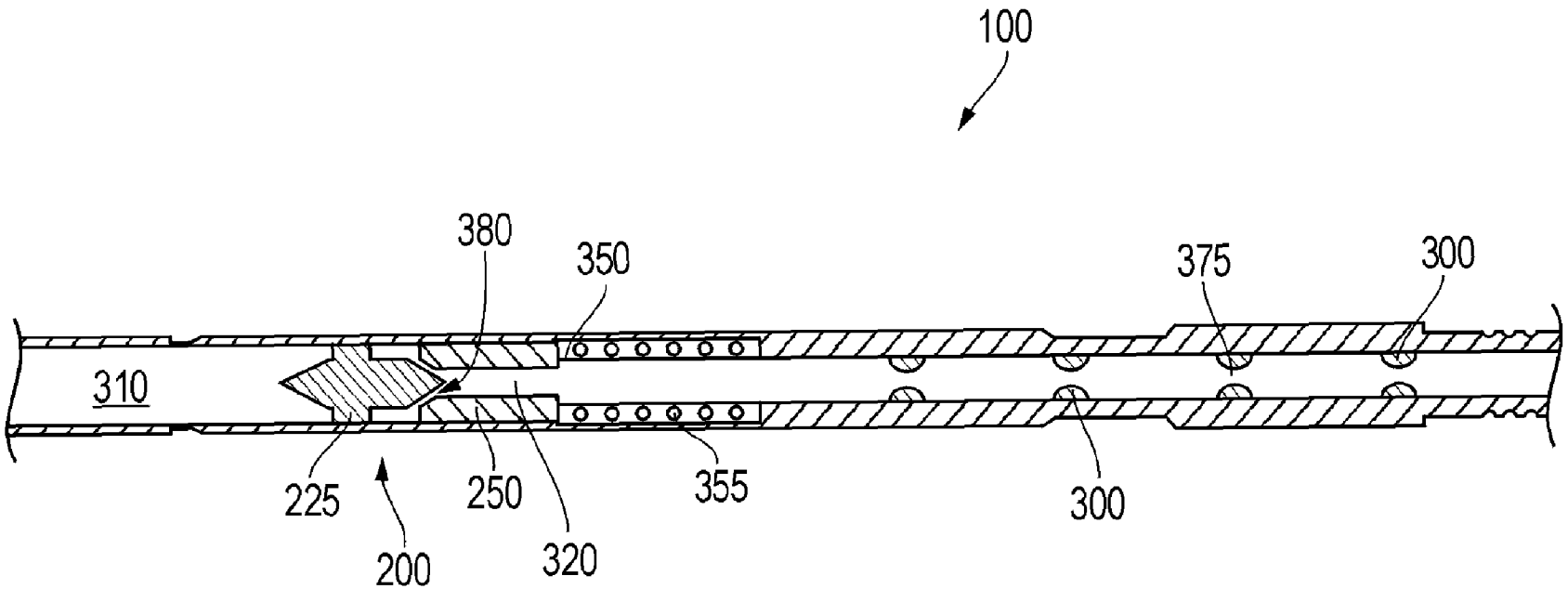
FIG. 3 is a cross-sectional view of the backpressure valve of FIGS. 1 and 2.

Continuing now with reference to FIG. 3, a detailed cross-section of the backpressure valve 100 is depicted, revealing a pressure generating mechanism that may be employed so as to substantially avoid throttling of the valve assembly 200 once opened. In the embodiment shown, the pressure generating mechanism includes a plurality of pressure generating flow-restrictors 300 positioned downhole of the valve assembly 200. However, a variety of alternative types of pressure generating mechanisms may be employed as noted below. Regardless, the pressure generating mechanism is disposed downhole of the valve assembly 200. Thus, pressure may be generated downhole of the valve assembly 200 once the interface 380 of the valve 225 and the seat 250 is opened as shown. In this manner, periodic throttling closure of the interface 380 may be avoided.

The above indicated throttling avoidance upon opening of the valve assembly 200 may be understood with reference to the fluid line through the backpressure valve 100. As shown in FIG. 3, the fluid line may be viewed as portions or chambers 310, 320 of the backpressure valve 100 at either side of the valve assembly 200. That is, an uphole chamber 310 is located uphole of the valve assembly 200 whereas a downhole chamber 320 is located downhole of the valve assembly 200. In the embodiment shown, the valve assembly 200 has been cracked open at the interface 380 allowing fluid communication between the chambers 310, 320. As a result of this communication an equilibrium of pressure between the chambers 310, 320 may be substantially achieved as a result of the pressure generating flow-restrictors 300 disposed within the downhole chamber 320. That is, a flow of fluid through the fluid line and the uphole chamber 310 may be employed to crack open the valve assembly 200. Subsequently, pressure within the downhole chamber 320 may be driven up by the presence of the flow-restrictors 300. As a result, pressure within the downhole chamber 320 may be driven up to a point of substantial equilibrium with the adjacent uphole chamber 310. In this manner, throttling of the valve assembly 200 may be substantially avoided as indicated above. Thus, once the backpressure valve 100 is opened, a pulse communication tool 170 may be effectively employed downhole of the backpressure valve 100. That is, wireless communication with a pressure detector 166 at the surface of the oilfield 115 may take place without significant concern over pressure pulse signals being killed by a throttling valve assembly 200 (see FIG. 1).

Continuing with reference to FIG. 3, with added reference to FIG. 1, the role of pressure between the chambers 310, 320 and at a spring 355 coupled to the valve seat 250 is described in greater detail. When the valve assembly 200 is in a closed position as depicted in FIG. 2, the backpressure valve 100 may be employed to maintain a column of fluid in the coiled tubing 155 as described above. Thus, leakage of fluid into the potentially low pressure well may be avoided. With reference to the scenario described above, about 5,000 PSI may be maintained within the uphole chamber 310 when the valve assembly 200 is closed. However, at this same time, the downhole chamber 320 may be open to the well sharing a common pressure therewith, for example about 2,000 PSI.

Given the 3,000 PSI disparity between the uphole 310 and downhole 320 chambers, a spring 355 is provided about a moveable mandrel 350 adjacent the valve seat 250 of the valve assembly 200. This spring 355 may be employed to hold the movable valve seat 250 in place keeping the valve assembly 200 closed until pressure conditions change. Alternative forms of resistance mechanisms other than a spring 355 may be employed for this purpose including belville washers or hydraulic resistance mechanisms. Regardless, in the scenario described above, the pressure in the downhole chamber 320 is about 3,000 PSI less than that of the uphole chamber 310. Therefore, the spring 355 may be configured to maintain 3,000 PSI or more of force on the movable valve seat 250 in order to keep the valve assembly 200 closed.

With about 3,000 PSI of force supplied by the spring 355, cracking open of the valve assembly may be achieved by the introduction of a pressure disparity between the chambers 310, 320 that is greater than 3,000 PSI. This increase in pressure may be directed by the fluid pump 164 at the surface of the oilfield 115. For example, in one embodiment, the fluid pump 164 may drive 1.5 barrels per minute (bpm) through the coiled tubing 155 and to the uphole chamber 310 increasing pressure therein to above 5,000 PSI. As such, a pressure disparity of greater than 3,000 PSI may be achieved, thereby overcoming the spring 355 to crack open the valve assembly 200 as depicted in FIG. 3.

Once the valve assembly 200 is cracked open, the uphole chamber 310 and the downhole chamber 320 are in direct communication through the interface 380. However, due to the configuration of the valve assembly 200 as detailed above, the tendency of the valve seat 250 to throttle relative to the valve 225 is avoided. More specifically, prevention of this throttling is achieved by the pressure generating mechanism disposed in the downhole chamber 320. In the embodiment shown, the pressure generating mechanism includes a plurality of flow restrictors 300 as described with an orifice 375 for regulating fluid passage therethrough.

The flow restrictors 300 serve to increase pressure in the downhole chamber 320 in response to an influx of fluid flow such as the 1.5 bpm noted above. As a result, periodic reduction in pressure in the downhole chamber 320 may be avoided, thereby allowing the valve assembly 200 to stay open. Pressure generation in this manner may be achieved through use of flow restrictors 300 as indicated. However, alternative forms of pressure generating mechanisms may be employed. For example, tubes or shafts of varying dimensions may be employed. In one embodiment, a shaft housing a plurality of washer shaped restrictors may be employed.

With reference to the particular embodiment of FIG. 3, the flow restrictors 300 may be about an inch in length with an outer diameter of about an inch matching the inner diameter of the downhole chamber 320. The orifices 375 of the flow restrictors 300 may be less than about 1.0 inches in diameter and of a tapered configuration. In such an embodiment, the introduction of about 1.5 bpm through the downhole chamber 320 may result in pressure generation of about 1,000 PSI at each of the four flow restrictors 300. The resulting 4,000 PSI increase would provide the downhole chamber 320 with a pressure of about 6,000 PSI (when accounting for the 2,000 PSI of well pressure). Thus, as indicated above, the pressure in the downhole chamber 320 is driven up to a level sufficient to keep the valve open (e.g. exceeding 5,000 PSI in the scenario as described above). As such, throttling of the valve assembly 200 may be avoided.

A variety of alternative sizing may be employed for the flow-restrictors 300 other than that described above. Indeed, sizing may change from one flow-restrictor 300 to the next with different restrictors 300 contributing a different predetermined percentage to the total pressure generation increase to the downhole chamber 320. Additionally, the number of flow-restrictors 300 employed may vary. However, in the embodiment shown, a sufficient number of restrictors 300 are employed so as to avoid the generation of vapor within the fluid, often referred to as cavitation. Such vapor would have a tendency to mask pressure pulse signals. However, with the principle of vena contracta in mind, a pressure drop at the orifice 375 that is roughly twice the pressure increase provided by any given restrictor 300 may be presumed and accounted for in determining the total number of flow restrictors 300 to be utilized. So, for example, with a starting pressure of about 2,000 PSI in downhole chamber 320 for the scenario described above, each restrictor 300 may be configured to contribute no more than about 1,000 PSI in response to 1.5 bpm as indicated. In this manner, a 'vena contracta' pressure drop of 2,000 PSI at the orifice 375 fails to result in a cavitation inducing pressure.

Figure 4A:
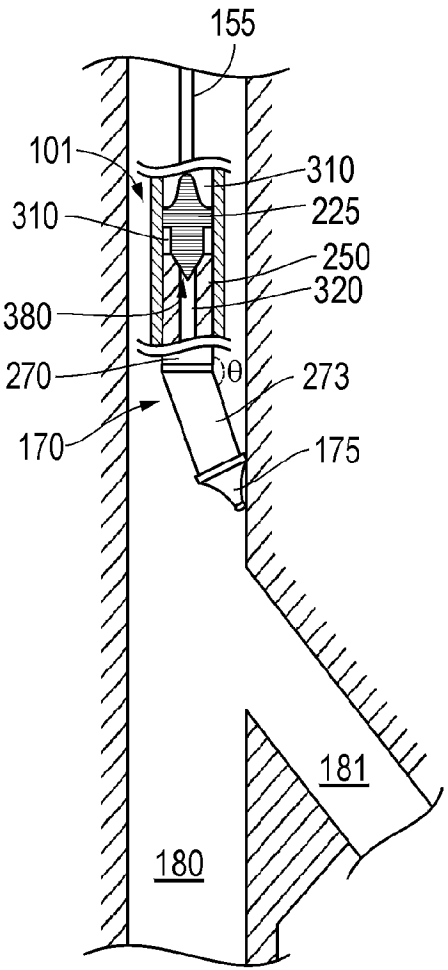
FIG. 4A is a side sectional view of the bottom hole assembly of FIG. 1 positioned at a first location in the well with the valve assembly of FIG. 2 closed.
Figure 4B:
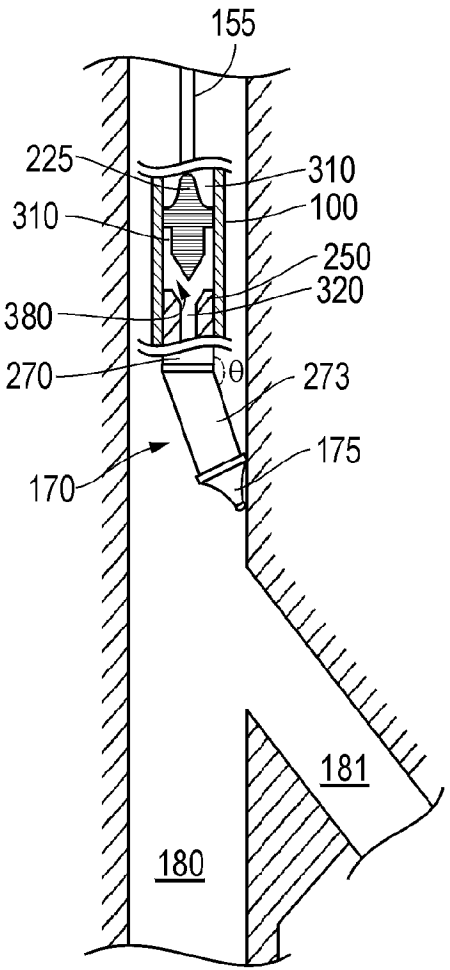
FIG. 4B is a is a side sectional view of the bottom hole assembly of FIG. 1 positioned at the first location in the well with the valve assembly of FIG. 2 open.
Figure 4C:
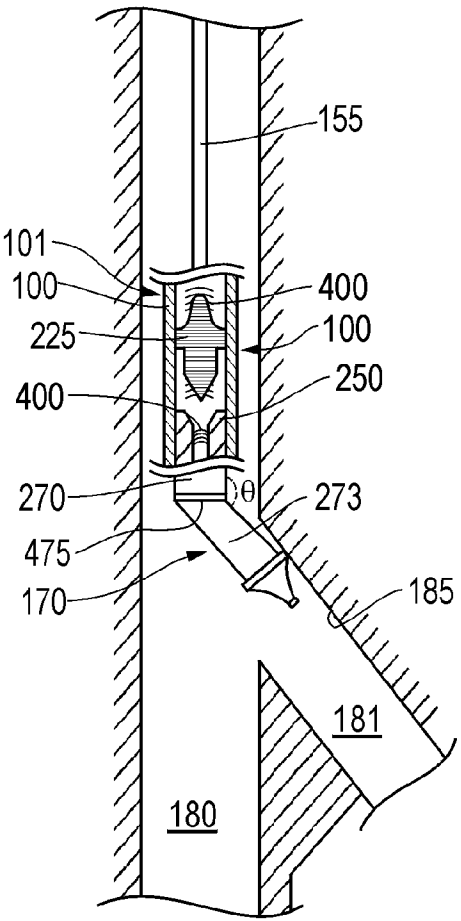
FIG. 4C is a is a side sectional view of the bottom hole assembly of FIG. 1 positioned at a second location in the well with the valve assembly of FIG. 2 open.

Continuing now with reference to FIGS. 4A-4C, a manner of employing the backpressure valve 100 in combination with a pressure pulse communication tool 170 is described. Cooperation between the backpressure valve 100 and the tool 170 may result in delivery of the entire borehole assembly 101 to the intended lateral leg 181 as depicted.

As shown in FIG. 4A, coiled tubing 155 is utilized to advance the bottom hole assembly 101 vertically through the main borehole 180. The arm 273 of the pressure pulse tool 170 is configured to flex about a hinge 475 of the tool 170 and toward the stationary portion 270 thereof. However, throughout most of the vertical downhole advancement of the assembly 101 the flexing of the arm 273 is substantially limited. This limitation on flexing is a result of the limited diameter of the borehole 180 which prevents further flexing and maintains an angle θ as depicted.

As the bottom hole assembly 101 is advanced downhole as depicted in FIG. 4A, the backpressure valve 100 may be closed. That is, the valve seat 250 may be closed against the valve 225 to prevent fluid leakage from the uphole chamber 310. The downhole chamber 320 may be in communication with the pressure pulse tool 170 and the well. However, at a time prior to searching for the lateral leg 181 or employing the clean-out nozzle 175, communication between the tool 170 and the uphole chamber 310 or other uphole equipment may be unnecessary.

Referring now to FIG. 4B, a locating operation may proceed wherein the pressure pulse tool 170 is employed to locate the lateral leg 181. For example, with added reference to FIG. 1, the fluid pump 164 may be employed to pump fluid through the coiled tubing 155 and crack open the interface 380 between the uphole 310 and downhole 320 chambers of the backpressure valve 100. The fluid pump 164 may be directed to open the interface 380 in this manner once the bottom hole assembly 101 has reached an estimated predetermined depth. For example, in one embodiment, the interface 380 is cracked open once the assembly 101 approaches to within about 20 feet of the estimated location of the lateral leg 181. With the interface 380 open in this manner, fluid may be pumped through the clean-out nozzle 175 as desired.

Continuing now with reference to FIG. 4C, opening of the backpressure valve 100 as indicated is achieved in a manner that avoids throttling closed of the interface 380 as detailed above. Thus, with added reference to FIG. 1, pressure pulse signals 400 emitted by the tool 170 may be transmitted all the way up the coiled tubing 155 and to the pressure detector 166 at the surface of the oilfield 115. In this manner an operator or automated equipment at the surface may be alerted as to the locating of the lateral leg 181 by the tool 170 as described below.

A variety of techniques may be employed for locating the lateral leg 181 with the tool 170. For example, it may be unlikely that the tool 170 would be initially oriented in line with the lateral leg 181 as depicted in FIGS. 4A-4B. Rather, the nozzle 175 may abut an opposite side of the borehole 180 relative to the lateral leg 181. As such, a series of advancing, retracting, and rotating of the bottom hole assembly 101 may proceed throughout a region where the lateral leg 181 is thought to be located. As the locating procedure is carried out, the backpressure valve 100 may be closed, for example, during periods of rotating the assembly 101 when encountering of the lateral leg 181 by the tool 170 is unlikely.

Regardless of the particular methodology employed for positioning and repositioning of the tool 170, once the arm 273 encounters the lateral leg 181, the effective diameter of the well increases. Thus, the arm 273 is able to increase its flex until encountering the wall 185 of the lateral leg 181. Stated another way, the angle θ at the hinge 475 is reduced. Reduction of the angle θ in this manner is utilized to set of a conventional pressure pulse mechanism within the tool 170. For example, this pressure pulse mechanism may act to increase the size of an orifice of the tool 170, thereby affecting a sudden pressure change on the fluid traveling therethrough. This sudden change in pressure may be transmitted uphole in the form of a pressure pulse 400. As noted above, due to the configuration of the backpressure valve 100 this pressure pulse 400 may be transmitted to a pressure detector 166 at the surface of the oilfield 115 without concern over the signal being killed by an intermittently throttling valve assembly 200 (see also FIG. 1).

Figure 5:
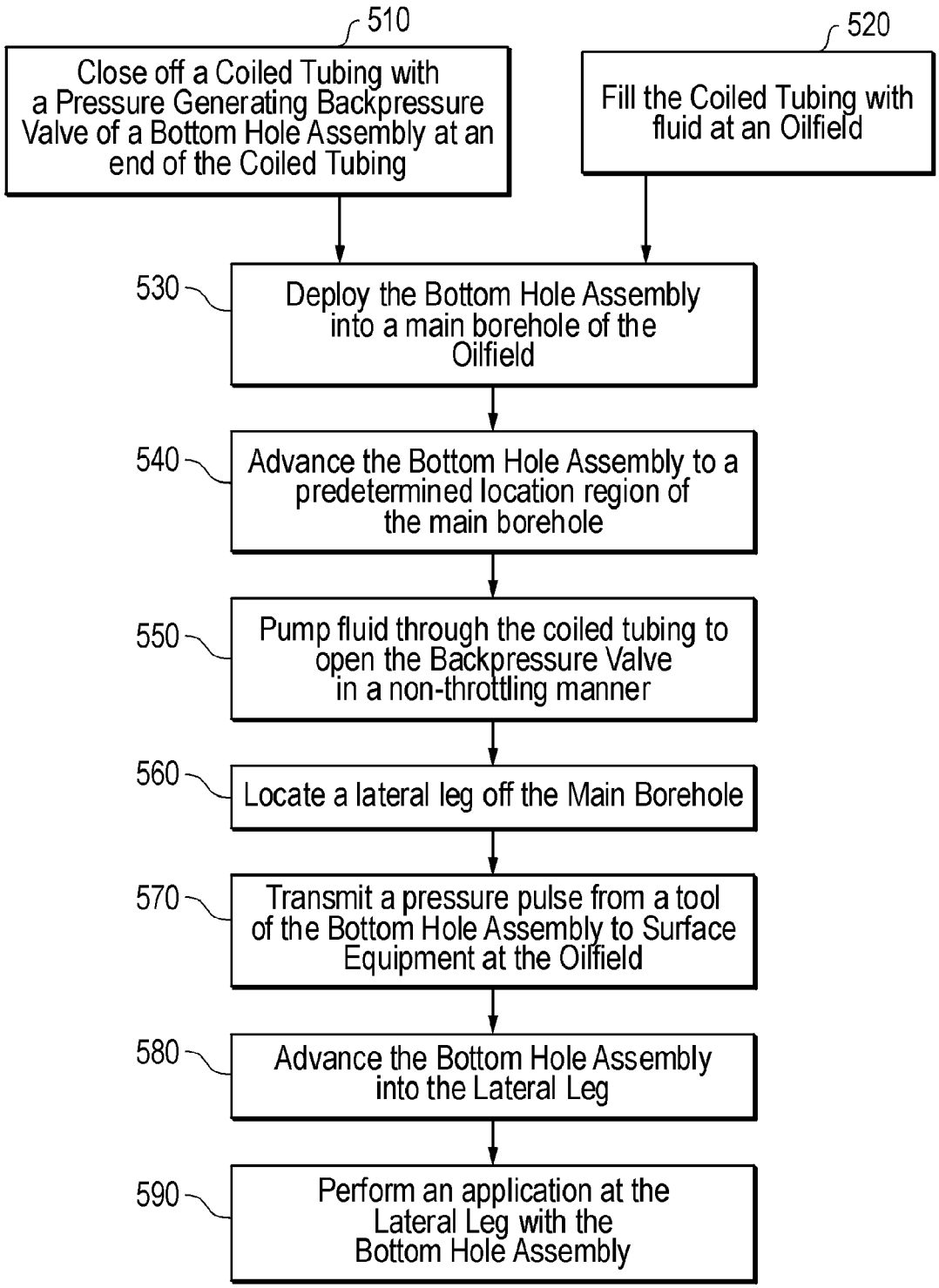
FIG. 5 is a flow-chart summarizing an embodiment of employing a backpressure valve with a pressure generating mechanism incorporated therein in a coiled tubing operation.

Referring now to FIG. 5, a method of cooperatively employing a backpressure valve and pressure pulse communication tool as noted above is summarized in the form of a flow-chart. The backpressure valve, having a pressure generating mechanism therein, and the tool are part of the same bottom hole assembly that is coupled to coiled tubing. The coiled tubing may be closed off by the backpressure valve and filled with fluid at an oilfield as indicated at 510 and 520. The coiled tubing may then be employed to advance the entire bottom hole assembly into a main borehole as noted at 530.

As indicated at 540, the bottom hole assembly may be advanced to a predetermined location region of the main borehole. As noted above, this region may be within a given distance of the estimated location of a lateral leg off of the main borehole. Once the bottom hole assembly is positioned in this region, fluid may be pumped through the coiled tubing and to the backpressure valve in order to open it. Additionally, due to the pressure generating configuration of the backpressure valve as detailed above, opening of the valve may be achieved in a non-throttling manner as indicated at 550. Thus, once the lateral leg is located by the tool downhole of the backpressure valve as noted at 560, a pressure pulse may be sent from the tool to surface equipment at the oilfield as indicated at 570 without concern over the pulse being killed by a throttling valve.

With information on hand regarding the precise location of the lateral leg, an operator may direct the entire bottom hole assembly into the lateral leg as indicated at 580. As a result, an application may be performed on the lateral leg as noted at 590. The application may involve a clean-out of debris, stimulation, scale removal, perforation forming, water conformance applications, inflatable packer placement, or a host of other lateral leg procedures.

Embodiments described hereinabove include a bottom hole assembly that is equipped with a cooperatively acting pressure pulse tool and backpressure valve that allow for a pressure pulse signal to be transmitted through the backpressure valve without concern over a throttling valve assembly killing the pressure pulse signal. Thus, the pressure pulse tool may communicate with equipment at the surface of the oilfield. Furthermore, the noted throttling is avoided in a manner that also avoids cavitatation of fluid within the backpressure valve. Thus, pressure pulse communication is not masked by the presence of any significant fluid vapor.

The preceding description has been presented with reference to presently preferred embodiments. Persons skilled in the art and technology to which these embodiments pertain will appreciate that alterations and changes in the described structures and methods of operation may be practiced without meaningfully departing from the principle, and scope of these embodiments. For example, embodiments depicted herein reveal a pressure pulse communication tool in the form of a multilateral tool. However, other embodiments of pressure pulse communication tools may be employed such as a casing collar locator tool. Furthermore, the foregoing description should not be read as pertaining only to the precise structures described and shown in the accompanying drawings, but rather should be read as consistent with and as support for the following claims, which are to have their fullest and fairest scope.

We claim:

1. A backpressure valve for substantially controlling pressure in a coiled tubing disposed within a well, the backpressure valve comprising:

a housing having an uphole portion for coupling to the coiled tubing and a downhole portion for coupling to a pulse communication tool;

a valve assembly disposed within said housing at an interface of the uphole portion and the downhole portion, said valve for opening and closing during the controlling; and a pressure generating mechanism disposed within the downhole portion for substantially avoiding throttling of said valve during the opening.

2. The backpressure valve of claim 1 wherein said valve assembly comprises;

a stationary valve;

a moveable valve seat to interface said stationary valve; and a resistance mechanism coupled to said moveable valve seat for holding said moveable valve seat at the interface until a predetermined pressure is present in said uphole portion.

3. The backpressure valve of claim 1 wherein said pressure generating mechanism is configured to substantially achieve an equilibrium of pressure between the uphole portion and the downhole portion for the avoiding.

4. The backpressure valve of claim 1 wherein said pressure generating mechanism is a flow restrictor.

5. The backpressure valve of claim 4 wherein the flow restrictor includes an orifice therethrough of less than about 1.0 inches.

6. The backpressure valve of claim 4 wherein said flow restrictor is of a tapered configuration.

7. The backpressure valve of claim 4 wherein said flow restrictor is configured to generate up to about 1,000 PSI.

8. The backpressure valve of claim 1 wherein said pressure generating mechanism is configured to avoid cavitation thereat.

9. The backpressure valve of claim 8 wherein said pressure generating mechanism comprises a plurality of flow restrictors.

10. The backpressure valve of claim 9 wherein each flow restrictor of said plurality is configured to contribute no more than a predetermined percentage of a total pressure generation in the downhole portion.

11. A bottom hole assembly for disposing in a well and comprising:

a backpressure valve with a valve assembly disposed between an uphole portion and a downhole portion of a housing, the downhole portion having a pressure generating mechanism disposed therein; and a pulse communication tool coupled to the downhole portion and configured for transmitting a pressure pulse signal to an uphole portion of the housing opposite the downhole portion during an opening of the valve assembly, the pressure generating mechanism configured to substantially prevent throttling of the valve assembly during the opening.

12. The bottom hole assembly of claim 11 wherein the pressure generating mechanism is configured to avoid cavitation thereat.

13. The bottom hole assembly of claim 11 wherein said pulse communication tool is configured for locating a physical feature in the well.

14. The bottom hole assembly of claim 13 wherein the physical feature is one of a lateral leg and a casing collar.

15. The bottom hole assembly of claim 11 wherein said pulse communication tool further comprises:

a stationary portion; and an arm portion coupled to said stationary portion, an angle between said stationary portion and said arm portion to effectuate the transmitting.

16. The bottom hole assembly of claim 11 further comprising an application tool coupled to said pulse communication tool for performing a well application in the well.

17. The bottom hole assembly of claim 16 wherein the well application is one of a clean-out, stimulation, scale removal, perforation, water conformance, and inflatable packer placement.

18. A bottom hole assembly for disposing in a well at an oilfield and comprising:

a housing for coupling to a coiled tubing and open to the well;

a pressure generating mechanism disposed within said housing to elevate a pressure in the housing relative to the well pressure upon introduction of fluid flow from the coiled tubing, said pressure generating mechanism configured to avoid cavitation thereat; and a tool coupled to said housing for communication with surface equipment at a surface of the oilfield.

19. The bottom hole assembly of claim 18 wherein said pressure generating mechanism comprises a plurality of flow restrictors with orifices therethrough.

20. A coiled tubing operation assembly for disposing in a well at an oilfield and comprising:

coiled tubing;

a backpressure valve coupled to said coiled tubing for substantially controlling pressure therein; and a pulse communication tool coupled to said backpressure valve and configured for transmitting a pressure pulse signal across said backpressure valve, said backpressure valve comprising a pressure generating mechanism to substantially prevent throttling of a valve assembly therein during the transmitting.

21. The coiled tubing operation assembly of claim 20 wherein said pressure generating mechanism is configured to avoid cavitation thereat.

22. The coiled tubing operation assembly of claim 20 further comprising surface equipment at the oilfield coupled to said coiled tubing for communicating with one of said backpressure valve and said pulse communication tool.

23. The coiled tubing operation assembly of claim 22 wherein said surface equipment comprises a fluid pump for opening the backpressure valve with hydraulic pressure.

24. The coiled tubing operation assembly of claim 22 wherein said surface equipment comprises a pressure detector to detect the pressure pulse signal from the transmitting.

25. A method of employing a bottom hole assembly in a well at an oilfield, the method comprising:

controlling fluid pressure in a coiled tubing with a backpressure valve of the bottom hole assembly;

deploying the bottom hole assembly into the well with the coiled tubing;

opening the backpressure valve; and maintaining said opening in a substantially non-throttling manner with a pressure generating mechanism of the bottom hole assembly.

26. The method of claim 25 wherein said opening comprises pumping fluid into the coiled tubing with a fluid pump at the oilfield.

27. The method of claim 25 wherein said maintaining is achieved in a manner avoiding cavitation at the pressure generating mechanism.

28. The method of claim 25 further comprising transmitting a pressure pulse across the backpressure valve from a pressure pulse tool of the bottom hole assembly during said maintaining.

29. The method of claim 28 further comprising detecting the pressure pulse with a pressure detector coupled to the coiled tubing at the oilfield.

30. The method of claim 29 wherein the well includes a main borehole with a lateral leg therefrom, the method further comprising:

advancing the bottom hole assembly to a predetermined location of the main borehole prior to said opening; and locating the lateral leg after said opening, said detecting to confirm said locating.

31. The method of claim 30 further comprising:

positioning the bottom hole assembly in the lateral leg; and performing a well application in the lateral leg.

32. The method of claim 31 wherein the well application is one of a clean-out, stimulation, scale removal, perforation, water conformance, and inflatable packer placement.

* * * * *